US010290941B2

(12) United States Patent
Irci et al.

(10) Patent No.: US 10,290,941 B2
(45) Date of Patent: May 14, 2019

(54) ELECTRONIC DEVICE HAVING MULTIBAND ANTENNA WITH EMBEDDED FILTER

(71) Applicant: Apple Inc., Cupertino, CA (US)

(72) Inventors: Erdinc Irci, Santa Clara, CA (US); Carlo Di Nallo, San Carlos, CA (US); Jayesh Nath, Milpitas, CA (US); Zheyu Wang, Cupertino, CA (US); Eduardo Da Costa Bras Lima, Sunnyvale, CA (US); Hongfei Hu, Santa Clara, CA (US); Mario Martinis, Cupertino, CA (US); Mattia Pascolini, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 364 days.

(21) Appl. No.: 15/008,130

(22) Filed: Jan. 27, 2016

(65) Prior Publication Data

US 2017/0214136 A1 Jul. 27, 2017

(51) Int. Cl.
*H01Q 1/24* (2006.01)
*H01Q 5/10* (2015.01)
(Continued)

(52) U.S. Cl.
CPC ..... *H01Q 5/321* (2015.01); *H01Q 1/243* (2013.01); *H01Q 5/10* (2015.01); *H01Q 9/42* (2013.01)

(58) Field of Classification Search
CPC ..... H01Q 1/243–1/244; H01Q 5/321
See application file for complete search history.

(56) References Cited

U.S. PATENT DOCUMENTS 7,436,365 B1 * 10/2008 Tan ..... H01Q 1/243 343/702
9,190,713 B2 * 11/2015 Eom ..... H01Q 1/243
(Continued)

FOREIGN PATENT DOCUMENTS

CN 101501926 A 8/2009
CN 202977704 U 6/2013
(Continued)

OTHER PUBLICATIONS

Chaudhary, G. et al., "Dual-Band Bandpass Filter with Independently Tunable Centre Frequencies and Bandwidths", IEEE Transactions on Microwave Theory and Techniques, vol. 61, No. 1, Jan. 2013.

*Primary Examiner* — Jessica Han
*Assistant Examiner* — Amal Patel
(74) *Attorney, Agent, or Firm* — Treyz Law Group, P.C.; G. Victor Treyz; David K. Cole

(57) ABSTRACT

An electronic device may have a display in a housing with a metal wall. An antenna may have an antenna ground formed from the wall and an antenna resonating element. Transceiver circuitry may be coupled to an antenna feed that extends between the antenna resonating element and the antenna ground. A return path may extend between the antenna resonating element and the antenna ground in parallel with the feed. The antenna resonating element may have segments that are coupled by a frequency dependent filter. At a first frequency, the filter may have a low impedance so that the antenna resonating element has a first effectively length. At a second frequency that is greater than the first frequency, the filter may have a high impedance so that the antenna resonating element has a second effective length that is shorter than the first effective length.

20 Claims, 12 Drawing Sheets

(51) Int. Cl.
*H01Q 9/42* (2006.01)
*H01Q 5/321* (2015.01)

(56) References Cited

U.S. PATENT DOCUMENTS

| | | | | |
|---|---|---|---|---|
| 2008/0272970 | A1 | 11/2008 | Chee et al. | |
| 2013/0102357 | A1 | 4/2013 | Vance | |
| 2013/0201067 | A1* | 8/2013 | Hu | H01Q 1/243 343/745 |
| 2013/0214979 | A1 | 8/2013 | McMilin et al. | |
| 2013/0278480 | A1 | 10/2013 | McMilin et al. | |
| 2014/0313087 | A1 | 10/2014 | Jiang et al. | |
| 2015/0002347 | A1 | 1/2015 | Jeong | |
| 2015/0002351 | A1 | 1/2015 | Jeong | |
| 2015/0303568 | A1 | 10/2015 | Yarga et al. | |

FOREIGN PATENT DOCUMENTS

| | | | |
|---|---|---|---|
| CN | 103337702 | A | 10/2013 |
| CN | 103904416 | A | 7/2014 |
| CN | 104079313 | A | 10/2014 |

* cited by examiner

ELECTRONIC DEVICE HAVING MULTIBAND ANTENNA WITH EMBEDDED FILTER

BACKGROUND

This relates generally to electronic devices and, more particularly, to electronic devices with wireless communications circuitry.

Electronic devices often include wireless communications circuitry. Radio-frequency transceivers are coupled to antennas to support communications with external equipment. During operation, a radio-frequency transceiver uses an antenna to transmit and receive wireless signals.

It can be challenging to incorporate wireless components such as antenna structures within an electronic device. If care is not taken, an antenna may consume more space within a device than desired or may exhibit unsatisfactory wireless performance.

It would therefore be desirable to be able to provide improved antennas for electronic devices.

SUMMARY

An electronic device may be provided with a housing in which a display is mounted. The housing may be formed from metal. The display may have a display module covered with a display cover layer. An antenna may have an antenna ground formed from a wall of the housing and an antenna resonating element formed from metal structures supported by a dielectric carrier. The antenna resonating element may run under the display cover layer along a peripheral portion of the display.

Radio-frequency transceiver circuitry may be coupled to an antenna feed that extends between the antenna resonating element and the antenna ground. A return path may extend between the antenna resonating element and the antenna ground in parallel with the antenna feed. The radio-frequency transceiver circuitry may be configured to operate at satellite navigation system and wireless local area network frequencies or other suitable frequencies.

The antenna resonating element may have segments that are coupled by a frequency dependent filter. At a first frequency, the filter may have a relatively low impedance so that the segments are joined to each other. In this state, the antenna resonating element has an effectively length that is relatively long and supports an antenna resonance at the first frequency. At a second frequency that is greater than the first frequency, the filter may have a relatively high impedance. In this state, the segments are electrically separated from each other so that the antenna resonating element has an effective length that is relatively short and supports an antenna resonance at the second frequency.

DETAILED DESCRIPTION

Figure 1:
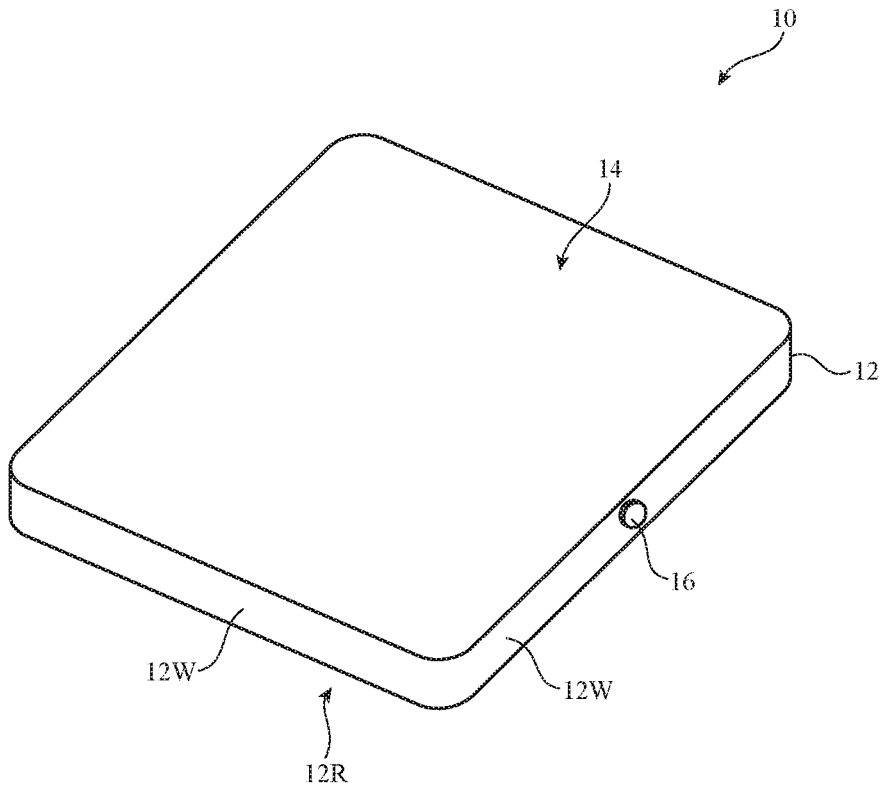
FIG. 1 is a perspective view of an illustrative electronic device with wireless communications circuitry in accordance with an embodiment.

An electronic device such as electronic device 10 of FIG. 1 may contain wireless circuitry. Device 10 may contain wireless communications circuitry that operates in long-range communications bands such as cellular telephone bands and wireless circuitry that operates in short-range communications bands such as the 2.4 GHz Bluetooth® band and the 2.4 GHz and 5 GHz WiFi® wireless local area network bands (sometimes referred to as IEEE 802.11 bands or wireless local area network communications bands). Device 10 may also contain wireless communications circuitry for implementing near-field communications, light-based wireless communications (e.g., infrared light communications and/or visible light communications), satellite navigation system communications (e.g., global positioning system communications at 1575 MHz or GLONASS communications), or other wireless communications. Illustrative configurations for the wireless circuitry of device 10 in which wireless communications are performed using an antenna that handles a 2.4 GHz communications band (e.g., a Bluetooth® and/or WiFi® link) and a global positioning system (GPS) satellite navigation system communications band and another antenna that handles cellular telephone communications may sometimes be described herein as an example.

Electronic device 10 may be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. In the illustrative configuration of FIG. 1, device 10 is a portable device such as a cellular telephone, media player, tablet computer, wristwatch device, or other portable computing device. Other configurations may be used for device 10 if desired. The example of FIG. 1 is merely illustrative.

In the example of FIG. 1, device 10 includes a display such as display 14 mounted in housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Device 10 may have opposing front and rear faces surrounded by sidewalls. Display 14 may have a planar or curved outer surface that forms the front face of device 10. The lower portion of housing 12, which may sometimes be referred to as rear housing wall 12R, may form the rear face of housing 12. Rear housing wall 12R may have a planar exterior surface (e.g., the rear of housing 12 may form a planar rear face for housing 12) or rear housing wall 12R may have a curved exterior surface or an exterior surface of other suitable shapes. Sidewalls 12W may have vertical exterior surfaces (e.g., surfaces that run vertically between display 14 and rear housing wall 12R), may have curved surfaces (e.g., surfaces that bow outwardly when viewed in cross section), may have beveled portions, may have profiles with straight and/or curved portions, or may have other suitable shapes. Device 10 may have a rectangular display and rectangular outline, may have a circular shape, or may have other suitable shapes.

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may include an array of display pixels formed from liquid crystal display (LCD) components, an array of electrophoretic display pixels, an array of plasma display pixels, an array of organic light-emitting diode display pixels or other light-emitting diodes, an array of electrowetting display pixels, or display pixels based on other display technologies.

Device 10 may include buttons such as button 16. There may be any suitable number of buttons in device 10 (e.g., a single button, more than one button, two or more buttons, five or more buttons, etc.). Buttons may be located in openings in housing 12 or in an opening in a display (as examples). Buttons for device 10 may be rotary buttons, sliding buttons, buttons that are actuated by pressing on a movable button member, etc. Button members for buttons such as button 16 may be formed from metal, glass, plastic, or other materials.

Figure 2:
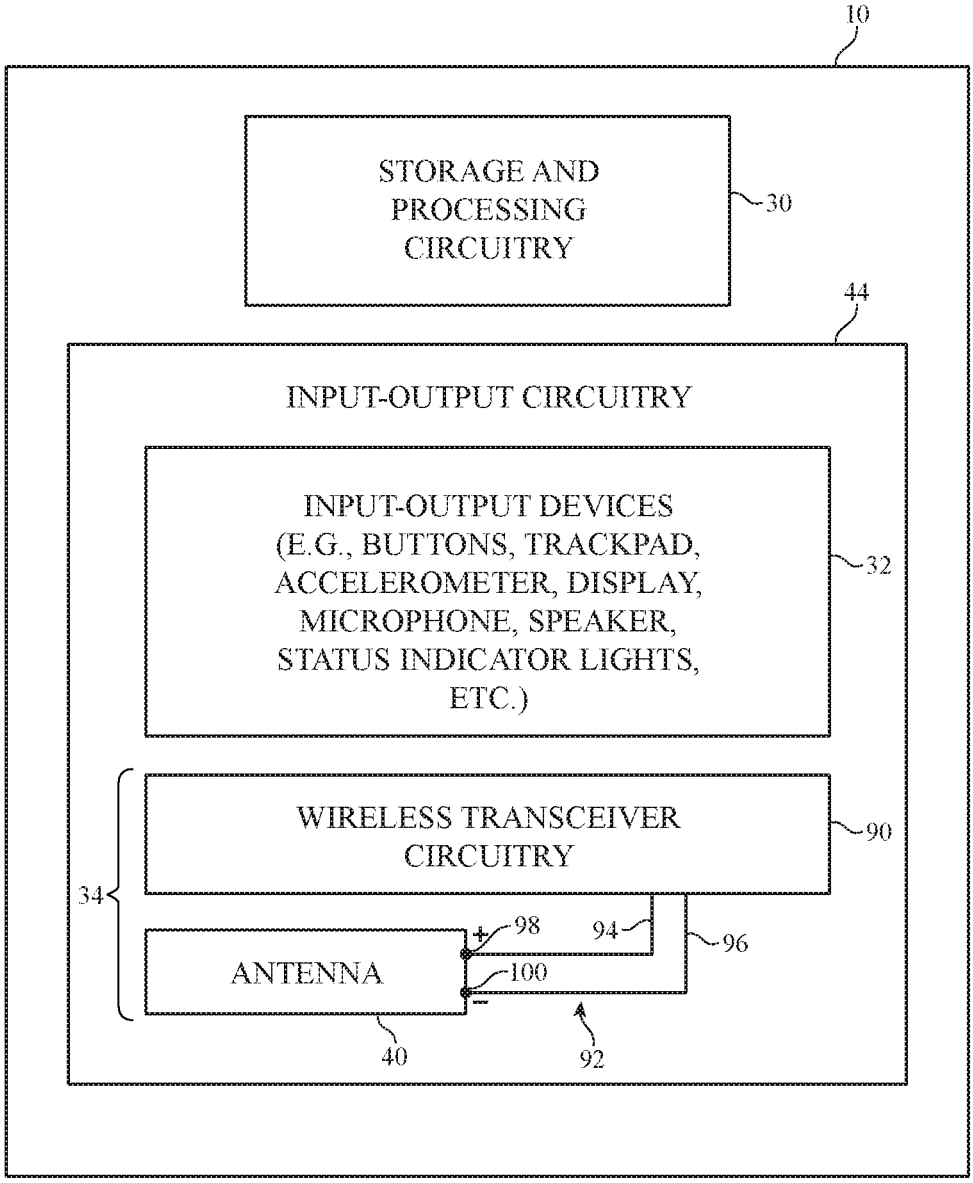
FIG. 2 is a schematic diagram of an illustrative electronic device with wireless communications circuitry in accordance with an embodiment.

A schematic diagram showing illustrative components that may be used in device 10 is shown in FIG. 2. As shown in FIG. 2, device 10 may include control circuitry such as storage and processing circuitry 30. Storage and processing circuitry 30 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 30 may be used to control the operation of device 10. This processing circuitry may be based on one or more microprocessors, microcontrollers, digital signal processors, baseband processor integrated circuits, application specific integrated circuits, etc.

Storage and processing circuitry 30 may be used to run software on device 10. For example, software running on device 10 may be used to process input commands from a user that are supplied using input-output components such as buttons, a touch screen such as display 14, force sensors (e.g., force sensors that are activated by pressing on display 14 or portions of display 14), accelerometers, light sensors, and other input-output circuitry. To support interactions with external equipment, storage and processing circuitry 30 may be used in implementing communications protocols. Communications protocols that may be implemented using storage and processing circuitry 30 include internet protocols, wireless local area network protocols (e.g., IEEE 802.11 protocols—sometimes referred to as WiFi®), protocols for other short-range wireless communications links such as the Bluetooth® protocol, protocols associated with receiving and processing satellite navigation system signals, etc.

Device 10 may include input-output circuitry 44. Input-output circuitry 44 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons, force sensors, joysticks, scrolling wheels, touch pads, key pads, keyboards, microphones, cameras, buttons, speakers, status indicators, light sources, audio jacks and other audio port components, digital data port devices, light sensors, motion sensors (accelerometers), capacitance sensors, proximity sensors (e.g., a capacitive proximity sensor and/or an infrared proximity sensor), magnetic sensors, and other sensors and input-output components.

Input-output circuitry 44 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include wireless local area network transceiver circuitry that may handle 2.4 GHz and 5 GHz bands for WiFi® (IEEE 802.11) communications, wireless transceiver circuitry that may handle the 2.4 GHz Bluetooth® communications band, cellular telephone transceiver circuitry for handling wireless communications in communications bands between 700 MHz and 2700 MHz or other suitable frequencies (as examples), or other wireless communications circuits. If desired, wireless communications circuitry 34 can include circuitry for other short-range and long-range wireless links. For example, wireless communications circuitry 34 may include 60 GHz transceiver circuitry, circuitry for receiving television and radio signals, paging system transceivers, near field communications (NFC) circuitry, satellite navigation system receiver circuitry (e.g., circuitry for receiving Global Positioning System signals at 1575 MHz or other satellite navigation system signals), etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include one or more antennas such as antenna 40. Antenna 40 may be formed using any suitable antenna type. For example, antenna 40 may be an antenna with a resonating element that is formed from loop antenna structures, patch antenna structures, inverted-F antenna structures, slot antenna structures, planar inverted-F antenna structures, helical antenna structures, hybrids of these designs, etc.

Transmission line paths such as transmission line 92 may be used to couple antenna 40 to transceiver circuitry 90. Transmission line 92 may be coupled to antenna feed structures associated with antenna structures 40. As an example, antenna structures 40 may form an inverted-F antenna or other type of antenna having an antenna feed with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 92. Other types of antenna feed arrangements may be used if desired. The illustrative feeding configuration of FIG. 2 is merely illustrative.

Transmission line 92 may include coaxial cable paths, microstrip transmission lines, stripline transmission lines, edge-coupled microstrip transmission lines, edge-coupled stripline transmission lines, transmission lines formed from combinations of transmission lines of these types, etc. Filter circuitry, switching circuitry, impedance matching circuitry, and other circuitry may be interposed within the transmission lines, if desired. Circuits for impedance matching circuitry may be formed from discrete components (e.g., surface mount technology components) or may be formed from housing structures, printed circuit board structures, traces on plastic supports, etc. Components such as these may also be used in forming filter circuitry.

The space available within device 10 for components such as antennas and other wireless circuitry may be limited. To help reduce the amount of space consumed by an antenna within device 10, the antenna may be provided with a resonating element that has one or more embedded filters. Filter circuitry for antenna 40 may have a frequency dependent behavior that allows the antenna to handle communications in multiple communications bands. At some frequencies, for example, a filter may serve as an open circuit that shortens the effective length of a resonating element, whereas at other frequencies the filter may serve as a short circuit that lengthens the effective length of the resonating element. By varying the effective length of an antenna resonating element in a frequency dependent fashion, multiple antenna resonances can be created. This allows the antenna to cover more communications bands of interest in a compact space.

Figure 3:
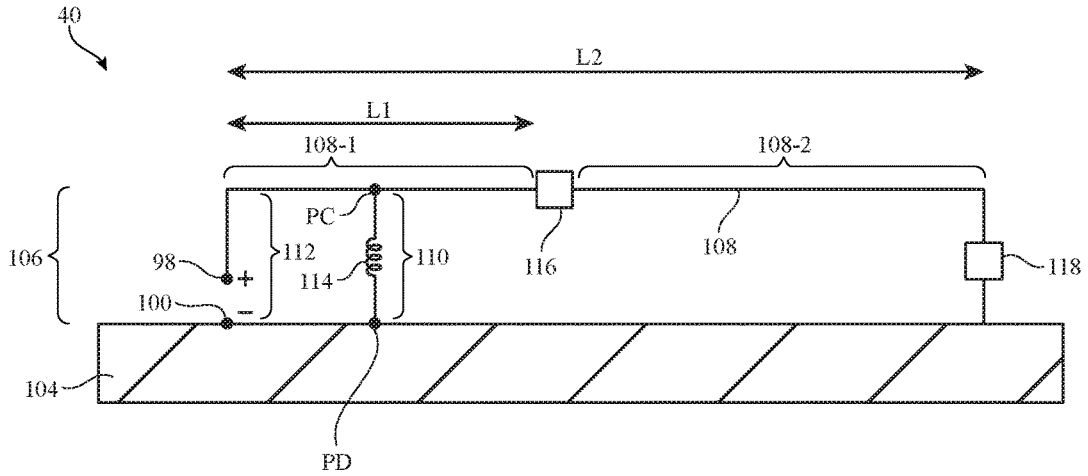
FIG. 3 is a schematic diagram of an illustrative antenna in accordance with an embodiment.

A schematic diagram of an illustrative antenna with an antenna resonating element having an embedded filter is shown in FIG. 3. Antenna 40 of FIG. 3 is an inverted-F antenna. This is merely illustrative. Antenna 40 may be any suitable type of antenna.

As shown in FIG. 3, antenna 40 has antenna ground 104 and inverted-F antenna resonating element 106. Antenna resonating element 106 has main arm 108. Return path 110 may be coupled between node PC on arm 108 and node PD on antenna ground 104. Antenna feed 112 may be formed from positive antenna feed terminal 98 and ground antenna feed terminal 100 and may be coupled between arm 108 and ground 104 in parallel with return path 110. Return path 110 may be formed from a strip of conductor (e.g., metal), may include a circuit element such as optional inductor 114, and may include other circuit components. If desired, tuning components such as component 118 may be coupled between arm 108 and ground 104. Component 118 may, for example, be a variable inductor or fixed inductor that is coupled between the end of arm 108 and ground 104.

Arm 108 may have multiple segments such as first segment 108-1 and second segment 108-2. Segment 108-1 may have a length L1. The combined lengths of segments 108-1 and 108-2 may be L2. Filter 116 may be interposed between segments 108-1 and 108-2 and may have a frequency dependent behavior. The frequency dependent response of filter 116 allows segments 108-1 and 108-2 to be decoupled (electrically isolated) at some frequencies and shorted together at other frequencies. As an example, filter 116 may be a band pass filter. With this arrangement, filter 116 may be a short circuit (i.e., filter 116 may exhibits a maximum transmittance T) in a first communications band at frequency f1 and may be an open circuit (i.e., filter 116 may exhibit a minimum transmittance T) at other frequencies, including in a second communications band a frequency f2. Frequency f1 may be, for example, a lower frequency such as 1575 MHz and may be associated with Global Positioning System (GPS) signals. Frequency f2 may be, for example, a higher frequency such as 2.4 GHz that is associated with IEEE 802.11 (WiFi®) wireless local area network communications and/or Bluetooth® communications.

With this type of arrangement, arm 108 has two effective lengths. At frequency f2, filter 116 is an open circuit, so the effective length of arm 108 is the length L1 of segment 108-1 (i.e., segment 108-2 is disconnected from the rest of element 108 and therefore does not contribute to the response of antenna 40). The length L1 of segment 108-1 may be a quarter of a wavelength at frequency f2 or may be another suitable length that supports an antenna resonance at f2. At frequency f1, filter 116 is a short circuit, so the effective length of arm 108 is L2 (because segments 108-1 and 108-2 are shorted together to form a longer arm). The length L2 may be a quarter of a wavelength at frequency f1 or may be another suitable length that supports an antenna resonance at f1.

As this example demonstrates, the presence of frequency-dependent filter 116 at a location partway along the length of antenna allows the length of arm 108 of antenna 40 to have different effective lengths at different operating frequencies without incorporating switches or other actively controlled components in arm 108 (although such components may be included, if desired). The ability to eliminate switches from arm 108 may allow arm 108 and antenna 40 to be implemented using few or no control lines, thereby conserving space within device 10. The ability to form an antenna that resonates in two different communications bands (frequencies f1 and f2) without need to resort to two separate resonating element arm branches of different lengths helps conserve space within device 10 (e.g., space along the periphery of display 14).

Figure 4:
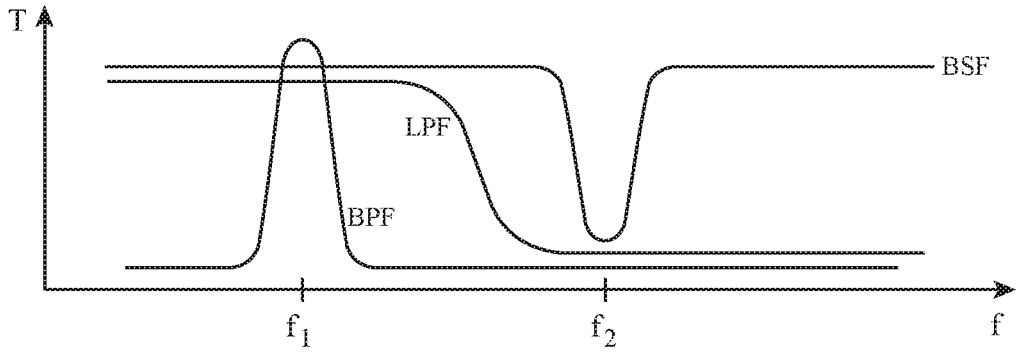
FIG. 4 is a graph of illustrative filter transmission characteristics for filters that may be incorporated into an antenna of the type shown in FIG. 3 in accordance with an embodiment.
Figure 5:
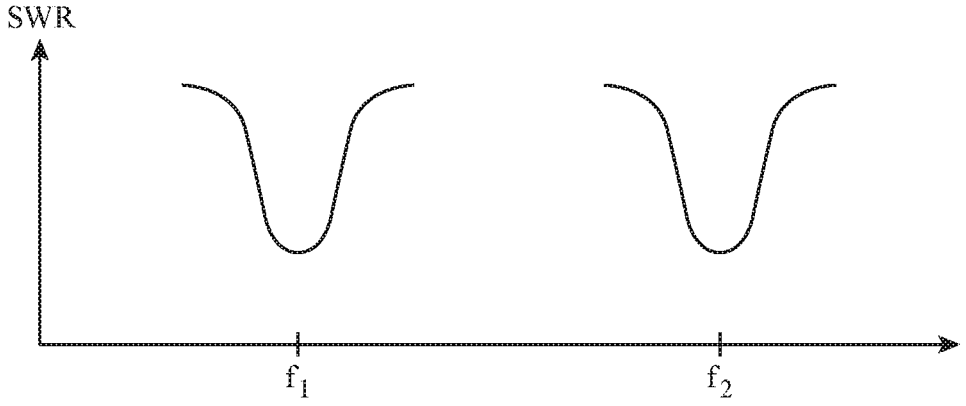
FIG. 5 is a graph in which antenna performance (standing wave ratio SWR) has been plotted as a function of operation frequency for an illustrative two segment antenna in accordance with an embodiment.

Filter 116 may have any suitable frequency-dependent response that differs at frequencies f1 and f2. As shown in the illustrative graph of FIG. 4 in which filter transmittance T has been plotted as a function of operating frequency f, filter 116 may be, for example, a band pass filter BPF with a peak transmission (minimum impedance) centered at frequency f1 and reduced transmission values (enhanced impedances) at other frequencies, may be a low-pass filter LPF with a cutoff frequency between frequencies f1 and f2, or may be a band stop filter BSF with a transmission valley at frequency f2 and higher transmission values at other frequencies. In the graph of FIG. 5, antenna performance (standing wave ratio SWR) has been plotted for antenna 40 of FIG. 3 as a function of operating frequency. As shown by the graph of FIG. 5, antenna 40 of FIG. 3 may exhibit first and second resonances covering respective communications bands at first frequency f1 and second frequency f2.

Figure 6:
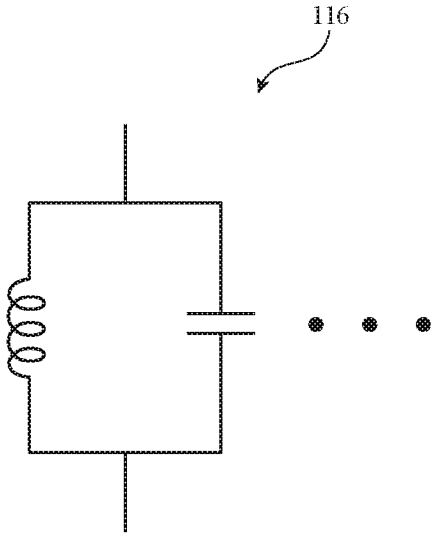
FIG. 6 is a circuit diagram of an illustrative parallel resonant band stop filter for an antenna in accordance with an embodiment.

FIG. 6 is a circuit diagram of an illustrative parallel resonant band stop filter of the type that may be used in forming band stop filter BSF (filter 116). There may be multiple resonant circuits of the type shown in FIG. 6 coupled in parallel between segments 108-1 and 108-2, each of which contributes a different portion of the band stop behavior of filter 116 (i.e., each of which contributes a band stop function at a different respective frequency at frequencies near to frequency f2).

Figure 7:
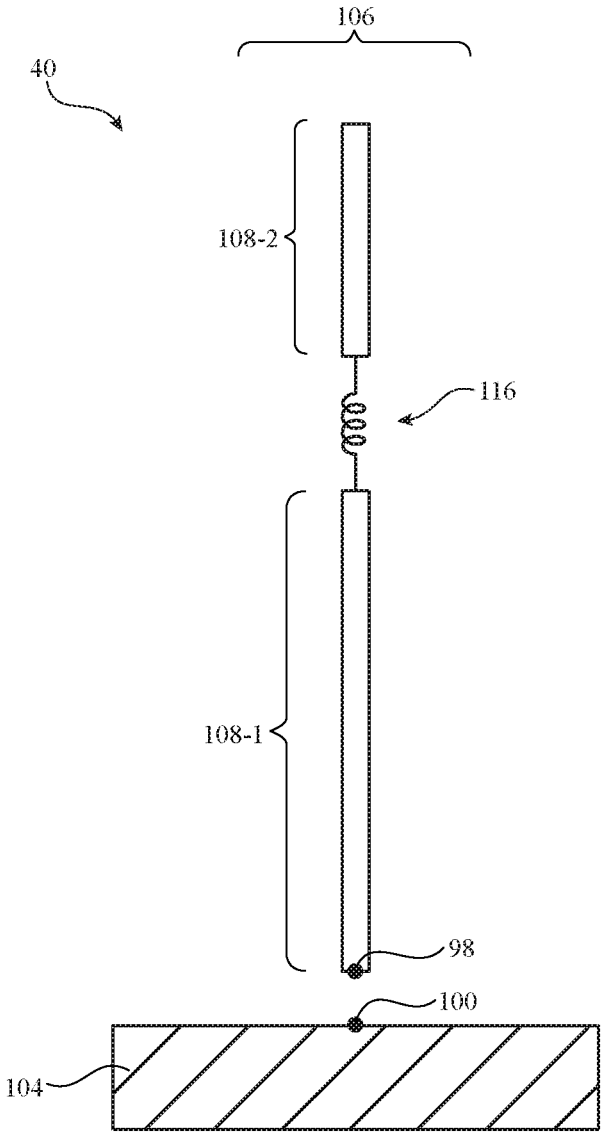
FIG. 7 is a diagram of an illustrative monopole antenna having a resonant element that includes a filter to adjust the effective length of the resonant element at different frequencies in accordance with an embodiment.

FIG. 7 is a diagram of antenna 40 in an illustrative configuration in which antenna 40 is a monopole antenna having a resonating element formed from an arm (arm 108) with first and second segments 108-1 and 108-2 that are joined by a filter (e.g., filter 116) formed from an inductor or other suitable low-pass circuitry. At lower frequency f1, filter 116 of FIG. 7 forms a closed circuit (low impedance) and at higher frequency f2, inductor 116 of FIG. 7 forms an open circuit (high impedance), thereby providing arm 108 with a length that effectively varies as a function of frequency, as described in connection with antenna 40 of FIG. 3.

Figure 8:
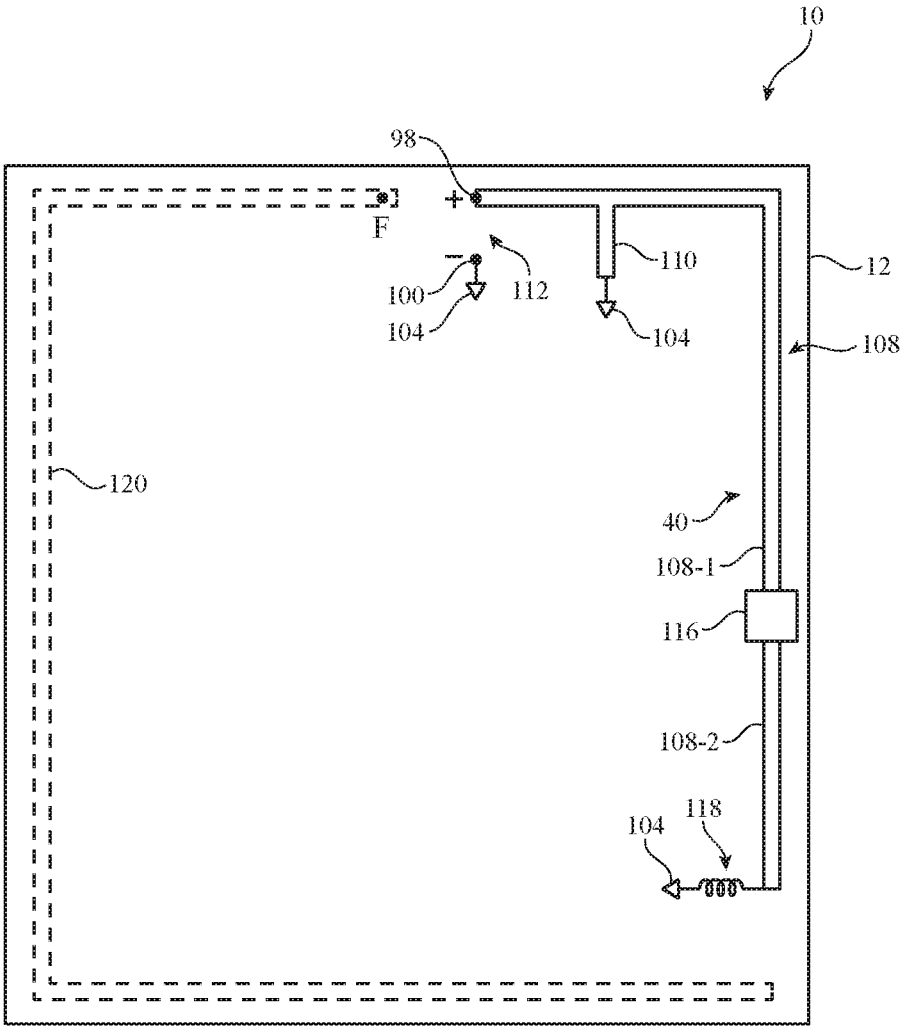
FIG. 8 is a top view of an illustrative electronic device showing how antennas can be arranged around the periphery of the electronic device in accordance with an embodiment.

Antennas for device 10 may run along peripheral edge portions of device 10 (e.g., under a dielectric display cover layer for display 14 or other suitable dielectric structure, on a peripheral conductive housing member, etc. As shown in FIG. 8, device housing 12 may contain multiple antennas. Antenna 120 may be a cellular telephone antenna or other suitable antenna and may run along three of the edges of housing. Antenna 40 may be an inverted-F antenna with an embedded filter (filter 116), as described in connection with FIG. 3. Antenna 120 may be feed at feed F and antenna 40 may be fed at feed 112. Antenna 40 may be formed under a dielectric structure such as a peripheral portion of a display cover layer for display 14. The display cover layer may be formed from glass, plastic, sapphire, and/or other dielectric materials that allow radio-frequency antenna signals associated with the operation of antennas 120 and 40 to pass. By using filter 116, the length of antenna 40 may be shortened, thereby helping to allow antennas 120 and 40 to fit within the limited space available in device 10.

Figure 9:
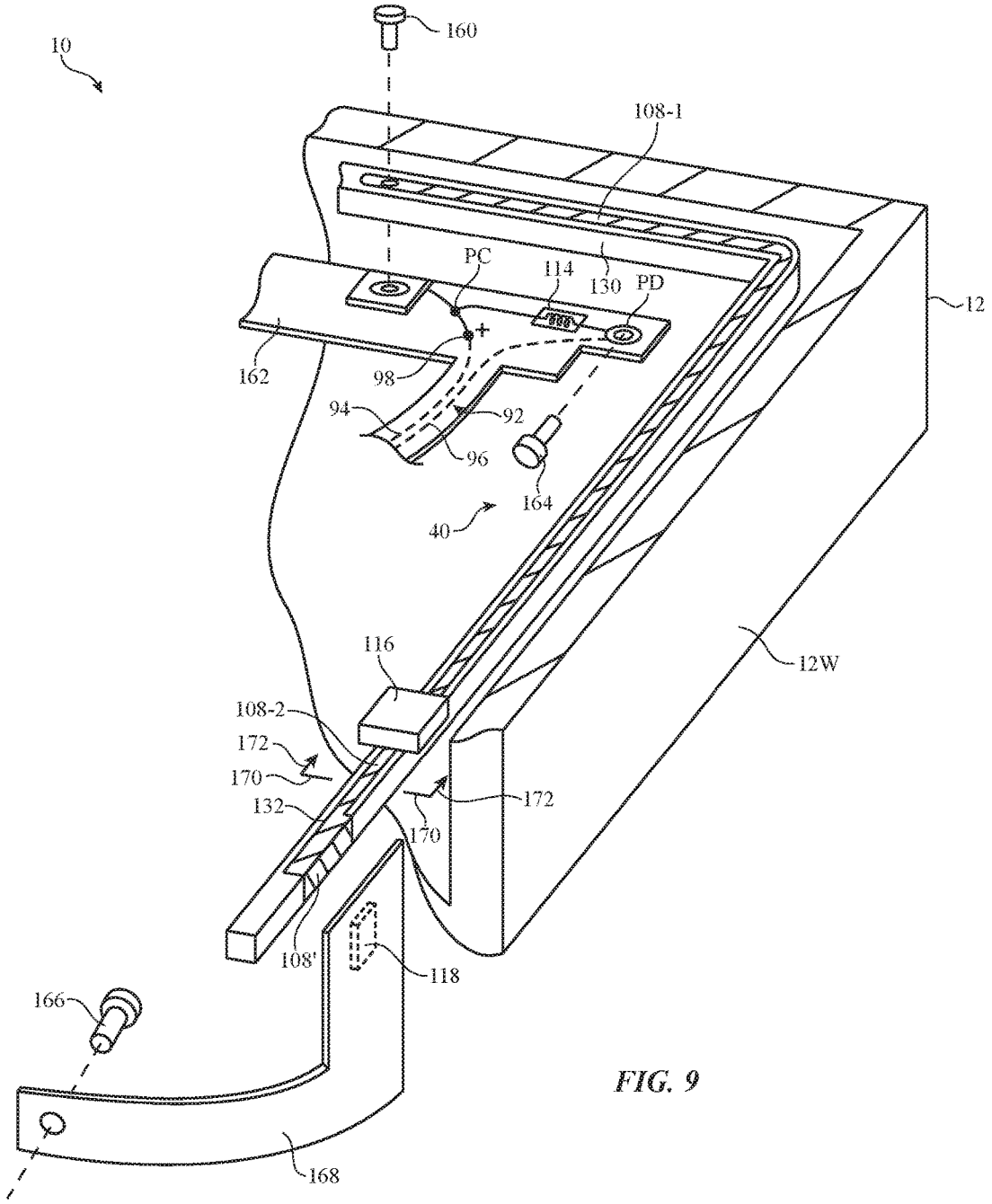
FIG. 9 is an exploded perspective view of an electronic device having an antenna in accordance with an embodiment.

A perspective interior view of antenna 40 of FIG. 8 is shown in FIG. 9. As shown in FIG. 9, antenna 40 may have a dielectric support structure such a plastic carrier 130. Metal structure 132 may form antenna resonating arm segments 108-1 and 108-2. A conductive structure such as screw 160 may couple arm 108-1 to a trace on flexible printed circuit 162 that is coupled to node PC. Traces 94 and 96 on printed circuit 162 may form transmission line 92 and may be coupled to transceiver circuitry 90. Feed terminal 98 may be coupled to trace 94 and node PC. A conductive structure such as screw 164 may couple a metal trace associated with node PD to the metal housing 12 of device 10, which serves as antenna ground 104. Inductor 114 may be mounted on printed circuit 162 and may be coupled between node PD and node PC. Illustrative locations for nodes PD and PC within antenna 40 are shown in the schematic diagram of antenna 40 of FIG. 3. Flexible printed circuit 168 may include a connector or other signal path coupling structure that couples portion 108' of segment 108-2 with metal traces on printed circuit 168. The metal traces on printed circuit 168 may form a path that couples inductor 118 to ground (metal housing 12) via a conductive structure such as screw 116, as shown in the schematic diagram for antenna 40 in FIG. 3.

Figure 10:
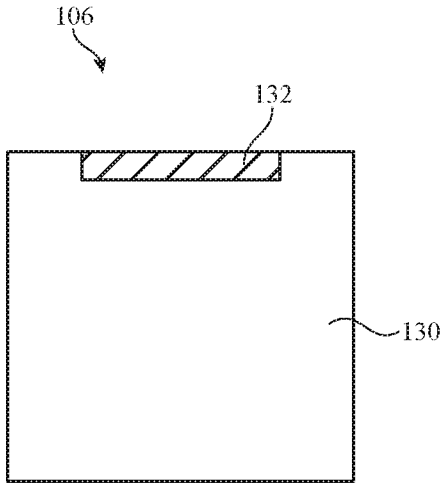
FIG. 10 is a cross-sectional side view of an illustrative electronic device antenna in accordance with an embodiment.

Metal structure 132 may be formed from a metal trace on plastic carrier 130, a strip of sheet metal, wire, or other conductive material. FIG. 10 is a cross-sectional view of carrier 130 that is taken along line 170 of FIG. 9 and viewed in direction 172. As shown in FIG. 10, carrier 130 may be formed from injection molded plastic and metal structures 132 for antenna resonating element 106 may be formed from strip of metal that is partly embedded within the injection molded plastic of carrier 130 (as an example).

Figure 11:
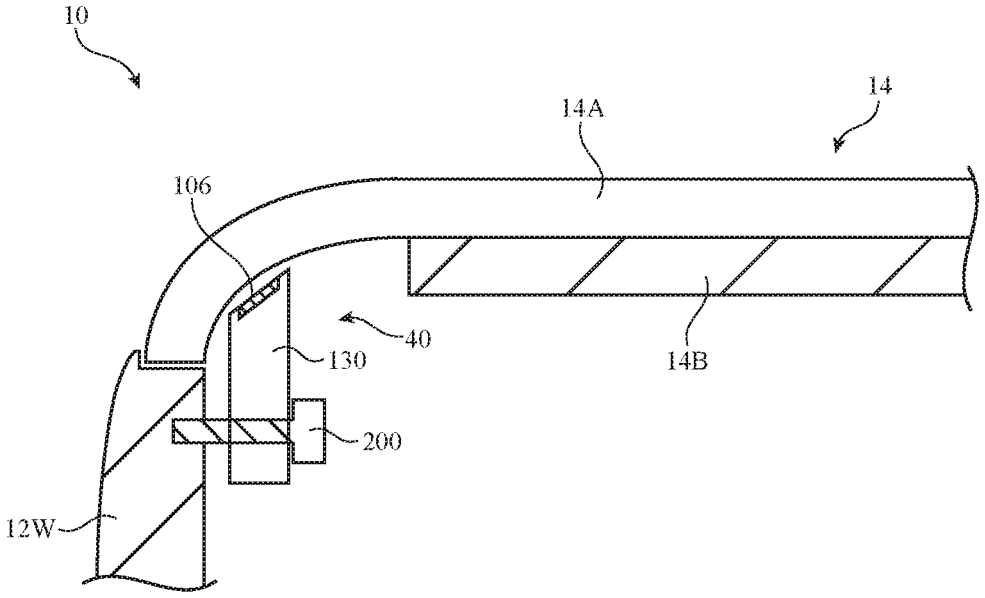
FIG. 11 is a cross-sectional side view of an illustrative electronic device showing how an antenna carrier may be mounted to a housing sidewall in accordance with an embodiment.

FIG. 11 is a cross-sectional view of a peripheral portion of device 10 showing how fastening structures such as screw 200 may be used to secure carrier 130 of antenna 40 to housing wall 12W (e.g., a metal housing wall). Antenna resonating element 106 may be located adjacent to an inner surface of display cover layer 14A and may, if desired, protrude into a groove or other recess in the inner surface of display cover layer 14A. Display 14 may include a display module such as display module (display) 14B (e.g., a light-emitting diode display, a liquid crystal display, display layers associated with other displays, etc.) that is mounted in the center of device 10 under cover layer 14A. Display cover layer 14A may overlap display 14B. Touch sensor structures for display 14 may be interposed between layer 14A and display 14B, may be incorporated into display 14B, or may be formed elsewhere in display 14. Antenna 40 may be mounted under a peripheral portion of display 14 (i.e., under a peripheral portion of display cover layer 14A and/or in a groove within layer 14A) and may run along the periphery of housing 12 (i.e., along sidewall 12W).

Figure 12:
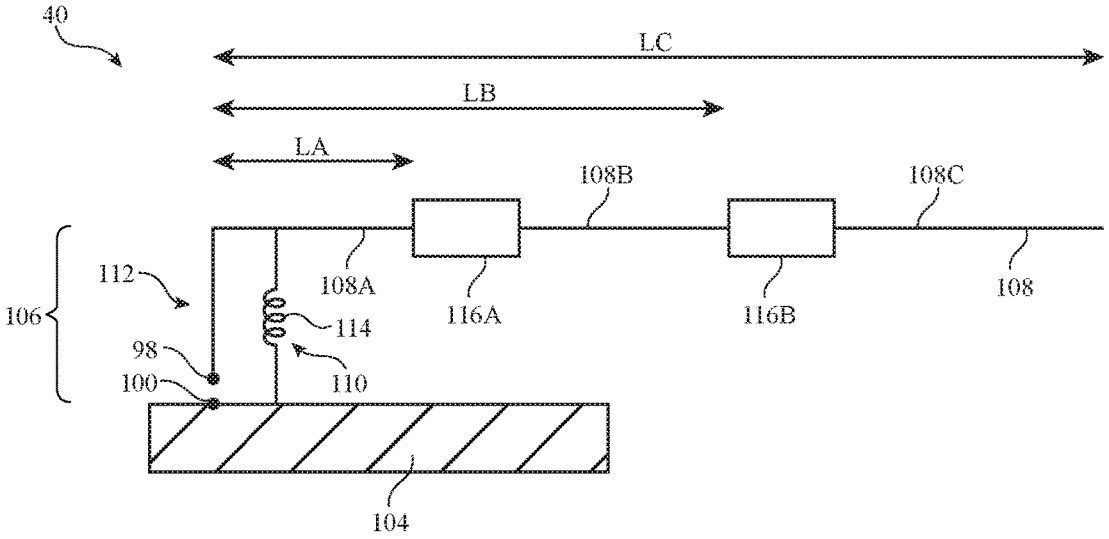
FIG. 12 is a diagram of an illustrative antenna with multiple embedded filters in accordance with an embodiment.

If desired, antenna 40 may contain multiple frequency dependent filters such as illustrative filters 116A and 116B of FIG. 12. In the example of FIG. 12, filter 116A is interposed between antenna resonating element arm segments 108A and 108B of arm 108 and filter 116B is interposed between segments 108B and 108C. Illustrative frequency-dependent transmission values T for filters 116A and 116B are shown by curves 202A and 202B of FIG. 13, respectively.

Figure 13:
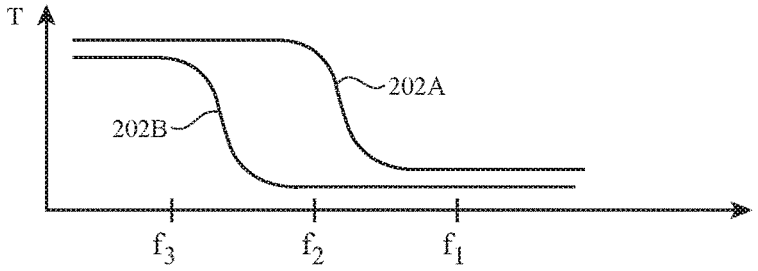
FIG. 13 is a graph in which filter transmission has been plotted as a function of operating frequency for filters of the type used in the antenna of FIG. 12 in accordance with an embodiment.

With the arrangement of FIGS. 12 and 13, the effective length of antenna resonating element 106 (i.e., arm 108) is LA at high frequencies such as frequency f3 at which filter 116A is an open circuit. At moderate frequencies such as frequency f2, filter 116A is a short circuit (i.e., transmission T of curve 202A is high and the impedance of filter 116A is low) and filter 116B is an open circuit (i.e., transmission T of curve 202B is low and the impedance of filter 116B is high). The effective length of arm 108 is therefore LB at moderate frequencies such as frequency f2. At low frequencies such as frequency f1, filters 116A and 116B are both short circuits and the transmission T of filters 116A and 116B is high, so the effective length of arm 108 is LC. The variable length of arm 108 allows antenna 40 to cover three different communications bands of interest (i.e., bands at frequencies f1, f2, and f3), without requiring arm 108 to have three separate branches or other potentially bulky structures to support antenna resonances at f1, f2, and f3.

The foregoing is merely illustrative and various modifications can be made by those skilled in the art without departing from the scope and spirit of the described embodiments. The foregoing embodiments may be implemented individually or in any combination.

What is claimed is:

1. An electronic device having an interior and an exterior, comprising:

a display having a transparent cover layer with a peripheral portion;

a housing having first and second metal walls that extend along the peripheral portion and that separate the interior from the exterior;

a first printed circuit attached to the first metal wall;

a second printed circuit attached to a portion of the housing; and an antenna having an antenna resonating element overlapped by the peripheral portion of the transparent cover layer, wherein the first and second metal walls form an antenna ground for the antenna, the antenna resonating element has a resonating element arm with an effective length, the antenna includes at least one frequency dependent filter in the antenna resonating element arm, the effective length varies with antenna operating frequency, the antenna resonating element has first and second segments, the first segment is parallel to the first and second metal walls and is grounded to the housing through the first printed circuit, and the second segment is parallel to the second metal wall and is grounded to the housing through the second printed circuit.

2. The electronic device defined in claim 1 wherein the antenna resonating element comprises an inverted-F antenna resonating element and the filter is coupled between the first and second segments.

3. The electronic device defined in claim 2 wherein the antenna comprises a dielectric carrier and wherein the first and second segments are formed from metal structures supported by the dielectric carrier.

4. The electronic device defined in claim 3 wherein the dielectric carrier comprises molded plastic and wherein the metal structures comprise metal strips embedded at least partly in the molded plastic.

5. The electronic device defined in claim 2 further comprising an inductor coupled between the first segment and the antenna ground.

6. The electronic device defined in claim 5 further comprising an antenna feed coupled between the first segment and the antenna ground in parallel with the inductor.

7. The electronic device defined in claim 2 further comprising a first inductor coupled between the first segment and the antenna ground and a second inductor coupled between the second segment and the antenna ground.

8. The electronic device defined in claim 7 wherein the filter comprises a filter selected from the group consisting of: a band stop filter, a band pass filter, and a low pass filter.

9. The electronic device defined in claim 8 further comprising radio-frequency transceiver circuitry coupled to the antenna, wherein the antenna is configured to resonate at a first frequency at which the filter has a first transmission level and at a second frequency that is higher than the first frequency at which the filter has a second transmission level that is lower than the first transmission level.

10. The electronic device defined in claim 9 wherein the first frequency is 1575 MHz, the second frequency is 2.4 GHz, and the electronic device further comprises a transmission line that is coupled between the radio-frequency transceiver circuitry and the antenna.

11. An electronic device with opposing front and rear faces, an interior, and an exterior, comprising:

a display;

a housing in which the display is mounted, wherein the display has a periphery and wherein the housing has first and second metal sidewalls that runs along the periphery and that separate the interior from the exterior;

a first printed circuit coupled to the first metal sidewall;

a second printed circuit coupled to a portion of the housing;

a transparent cover layer that covers the display and has a peripheral portion that overlaps the periphery of the display; and an antenna having an antenna resonating element arm that is overlapped by the peripheral portion of the transparent cover layer and that extends parallel to at least a portion of the first and second metal sidewalls, wherein the antenna is coupled to the first printed circuit and is thereby grounded to the first metal sidewall, the antenna is coupled to the second printed circuit and is thereby grounded to the portion of the housing, the antenna resonating element arm has first and second segments joined by a frequency dependent filter, and the antenna resonates at a first frequency at which the filter has a first transmission level and at a second frequency that is higher than the first frequency at which the filter has a second transmission level that is lower than the first transmission level.

12. The electronic device defined in claim 11 wherein the antenna is coupled to the first printed circuit using a first connector, the first printed circuit is coupled to the first metal sidewall using a second connector, the electronic device further comprising an inductor coupled between the first connector and the second connector on the first printed circuit.

13. The electronic device defined in claim 12 further comprising an antenna feed coupled between the first connector and the second connector on the printed circuit in parallel with the inductor.

14. The electronic device defined in claim 13 wherein the second printed circuit is connected to the portion of the housing with a third connector, the electronic device further comprising a second inductor coupled between the second segment and the third connector on the second printed circuit.

15. The electronic device defined in claim 11 wherein the antenna is coupled to the first printed circuit using a first connector, the first printed circuit is coupled to the first metal sidewall using a second connector, the antenna resonating element arm comprises an inverted-F antenna resonating arm, and the antenna has a feed coupled between the first connector and the second connector on the first printed circuit and a return path coupled between the first connector and the second connector on the first printed circuit in parallel with the antenna feed.

16. The electronic device defined in claim 11 wherein the antenna comprises a molded plastic carrier and wherein the first and second segments are formed from metal strips that are at least partly embedded within the molded plastic carrier.

17. The electronic device defined in claim 11 wherein the filter comprises a band stop filter having a stop band at the second frequency.

18. The electronic device defined in claim 11 wherein the filter comprises a filter selected from the group consisting of: a band pass filter and a low pass filter.

19. An electronic device having an interior and an exterior, comprising:

a housing having first and second metal walls that separate the interior from the exterior;

a display in the housing;

a first printed circuit attached to the first metal wall;

a second printed circuit attached to a portion of the housing;

an antenna having an antenna resonating element arm with first, second, and third segments and having an antenna ground, wherein the first segment is parallel to the first and second metal walls and is grounded to the housing through the first printed circuit, the second segment is parallel to the second metal wall and is grounded to the housing through the second printed circuit, the antenna includes a first filter between the first and second segments, includes a second filter between the second and third segments, and includes an antenna feed; and radio-frequency transceiver circuitry that is coupled to the antenna feed and that is configured to operate in first, second, and third communications bands.

20. The electronic device defined in claim 19 wherein the radio-frequency transceiver circuitry is configured to operate in the third communications band when the first filter forms an open circuit, wherein the radio-frequency transceiver circuitry is configured to operate in the second communications band when the first filter forms a short circuit and the second filter forms an open circuit, and wherein the radio-frequency transceiver circuitry is configured to operate in the first communications band when the first filter and second filters form short circuits.

* * * * *